US007310898B2

(12) United States Patent
Wei

(10) Patent No.: US 7,310,898 B2
(45) Date of Patent: Dec. 25, 2007

(54) MODULARIZED MULTIFUNCTIONAL IRONING BOARD WITH FAN

(76) Inventor: Bai-Dong Wei, 3F, No. 6, Alley 9, Lane 54, Hulu St., Shlin Chiu, Taipei City (TW) 111

( * ) Notice: Subject to any disclaimer, the term of this patent is extended or adjusted under 35 U.S.C. 154(b) by 592 days.

(21) Appl. No.: 10/435,542

(22) Filed: May 12, 2003

(65) Prior Publication Data

US 2004/0226197 A1 Nov. 18, 2004

(51) Int. Cl.
*D06F 81/00* (2006.01)

(52) U.S. Cl. ..... 38/112; 38/107; 416/247 R

(58) Field of Classification Search ..... 38/103, 38/104, 106, 107, 112, 137; 108/1, 11, 91, 108/157, 28, 33; D23/411, 381, 370; 416/247 R
See application file for complete search history.

(56) References Cited

U.S. PATENT DOCUMENTS 2,495,468 A * 1/1950 Mueller ..... 38/104
2,645,046 A * 7/1953 Frej ..... 38/137
5,329,710 A * 7/1994 Huddleston ..... 38/104
5,572,811 A * 11/1996 Lehrman ..... 38/106
6,138,390 A * 10/2000 Wu ..... 38/112

* cited by examiner

*Primary Examiner*—Ismael Izaguirre

(57) ABSTRACT

The invention relates to a modularized multifunctional ironing board with fan, consisting of an ironing board with ventilation holes, a cotton fabric layer on top, a fan, and supporting all the above a rack assembly base. By conjoining the ironing board and the fan underneath the board proper, steam from an iron can be sucked out through the ventilation holes while the clothes being ironed is stationary by the suction power of the fan to facilitate the action thereof and that the user can be safe guarded from steam, rendering the ironing process fast and easy.

2 Claims, 5 Drawing Sheets

MODULARIZED MULTIFUNCTIONAL IRONING BOARD WITH FAN

BACKGROUND OF THE INVENTION (A) Field of the Invention

The invention relates to a modularized multifunctional structure for the purpose of ironing. It is a structure of a combining a fan and an ironing board. The invention consists of a rack assembly base, a fan, and an ironing board with ventilation holes. With the fan working under the ironing board, sucking and dissipating the steam from above through the ventilation holes to below and stabilizing the clothing while preventing steam to reach the face of the person ironing are achieved, thus rendering a fast and easy ironing.

(B) Description of the Prior Art

The usual household ironing board is made up of a wooden board proper with a top fabric layer encasing a layer of foam and fastening the board to a foldable rack base. Such is the tool for the ironing industry; however, this type of board has the following shortcomings:

The steam keeps ascending to the face of the user who must tolerate not only heat but also the odor of the steam, making ironing a challenge. In addition, the width of the board is much narrower than the clothing resulting in unstable sliding of the clothing. For example, while positioning the sleeve of a shirt to be ironed, the rest of the shirt will tend to slide off the board simply by the shirt's own weight. If the clothing is a coat of heavy type, the inconvenience for smooth ironing is more apparent.

SUMMARY OF THE INVENTION

Therefore, the object of the invention is to attain smooth, fast and easy ironing by producing a new type of ironing board which would improve all the shortcomings of the traditional board. The final product is easy to be stored and taken out, to prevent slipping and providing stabilization of the clothing, to ventilate steam, and to provide access of electricity for the iron—truly practical and multifunctional.

In order to attain such goal, the invention relates to a modularized multifunctional structure for the purpose of ironing. It is a structure of a combining a fan and an ironing board. The invention consists of a rack assembly base, a fan, and an ironing board with ventilation holes. With the fan working under the ironing board, sucking and dissipating the steam from above through the ventilation holes to below and stabilizing the clothing while preventing steam to reach the face of the person ironing are achieved, thus rendering a fast and easy ironing.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

To better understand the characteristics and novelties of the invention, descriptions shall be given with the accompanying drawings hereunder.

Figure 1:
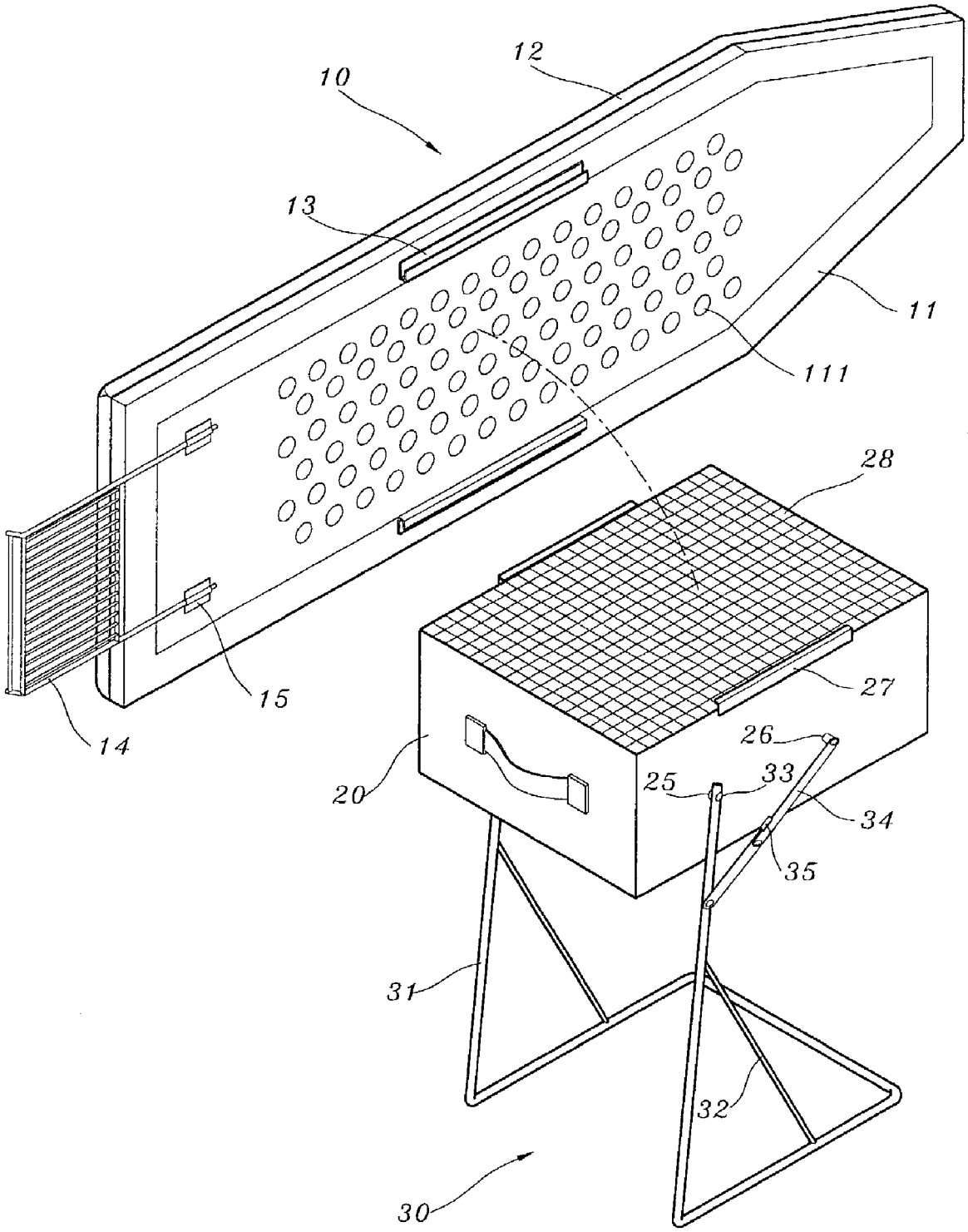
FIG. 1 shows a perspective exploded view of the entire structural combination according to the invention.
Figure 2:
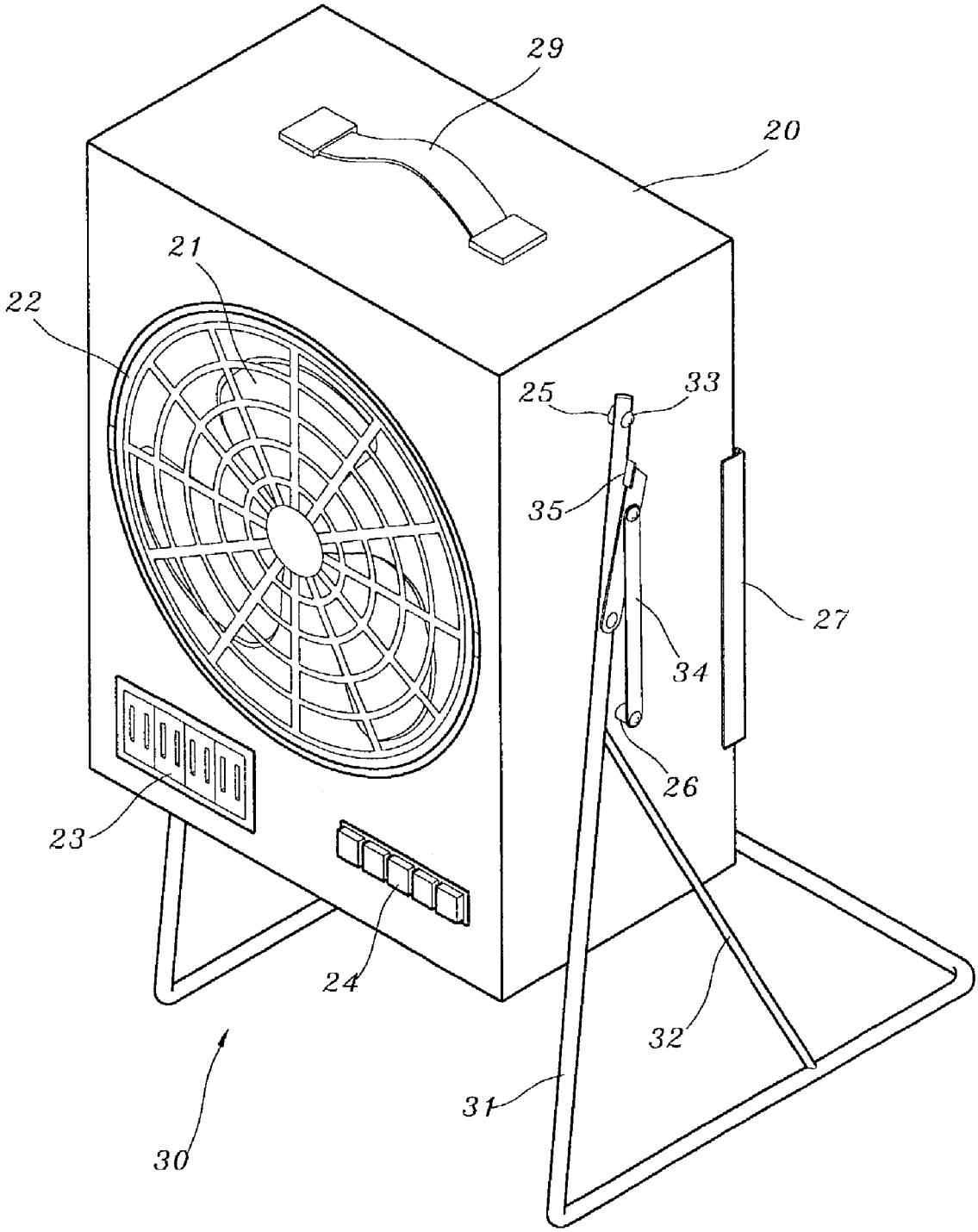
FIG. 2 shows a perspective schematic view of the fan assembled with the supporting racks according to the invention.
Figure 3:
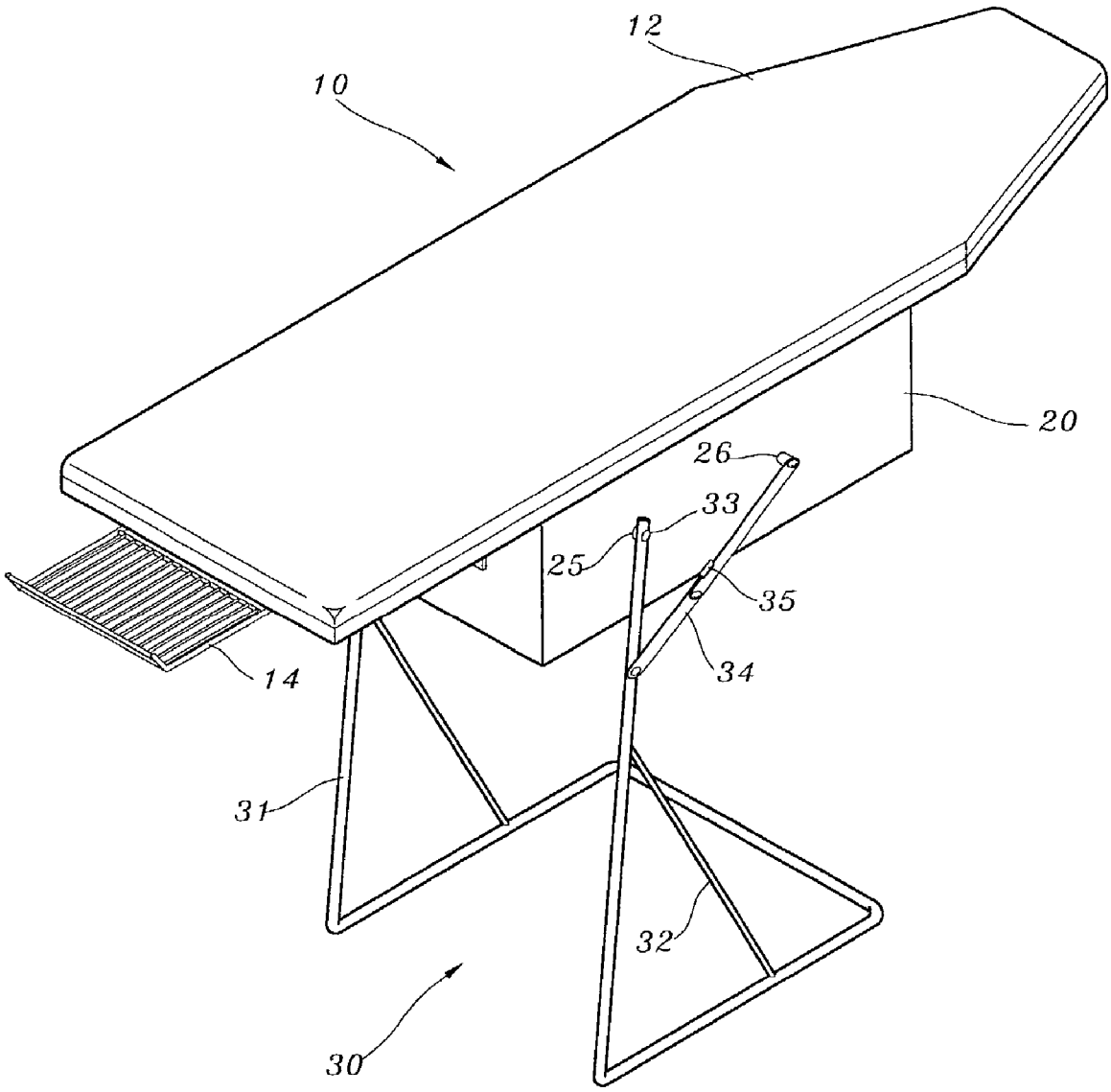
FIG. 3 shows a perspective schematic view in complete assembly according to the invention.
Figure 4:
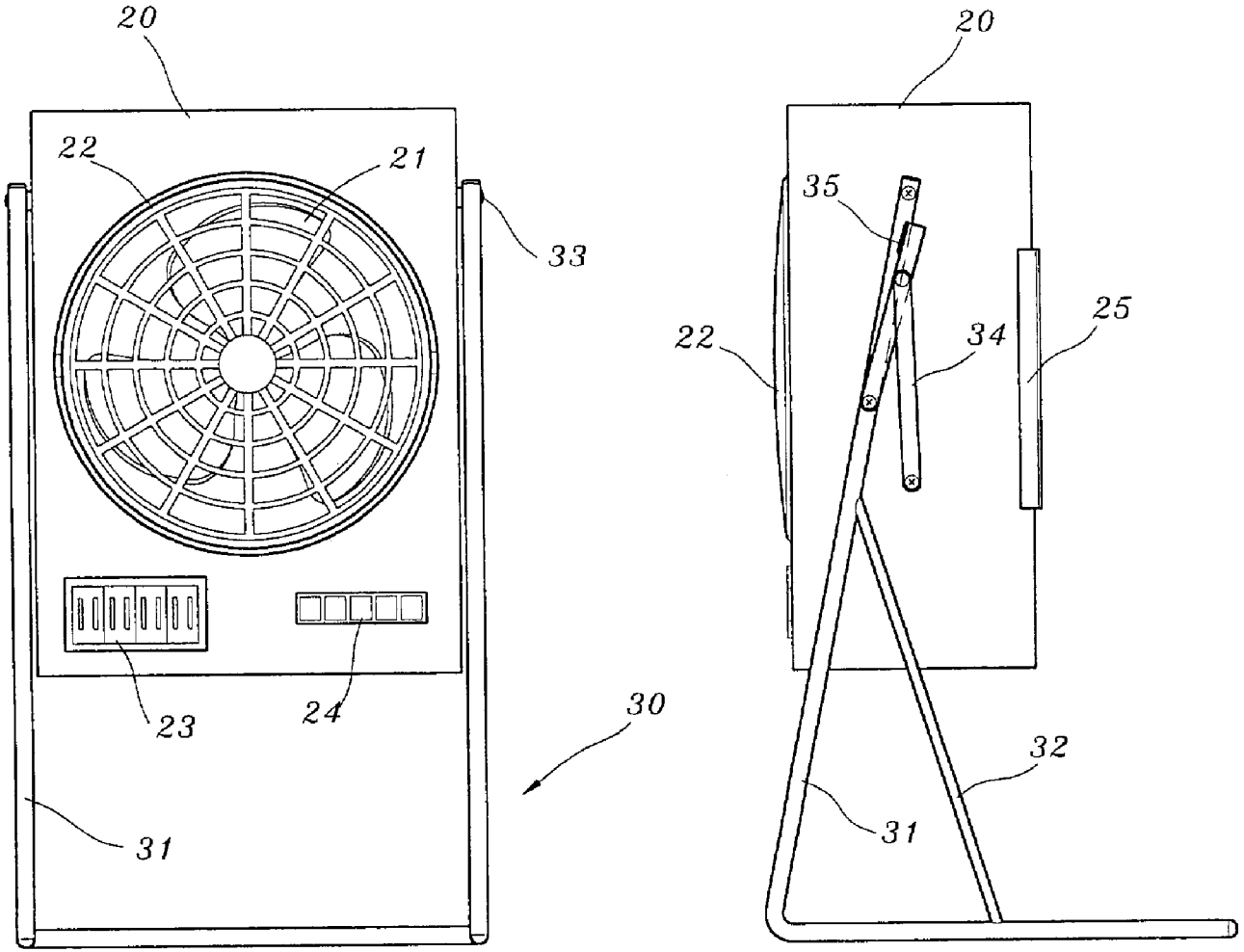
FIG. 4 shows frontal and side views of the fan assembly according to the invention.
Figure 5:
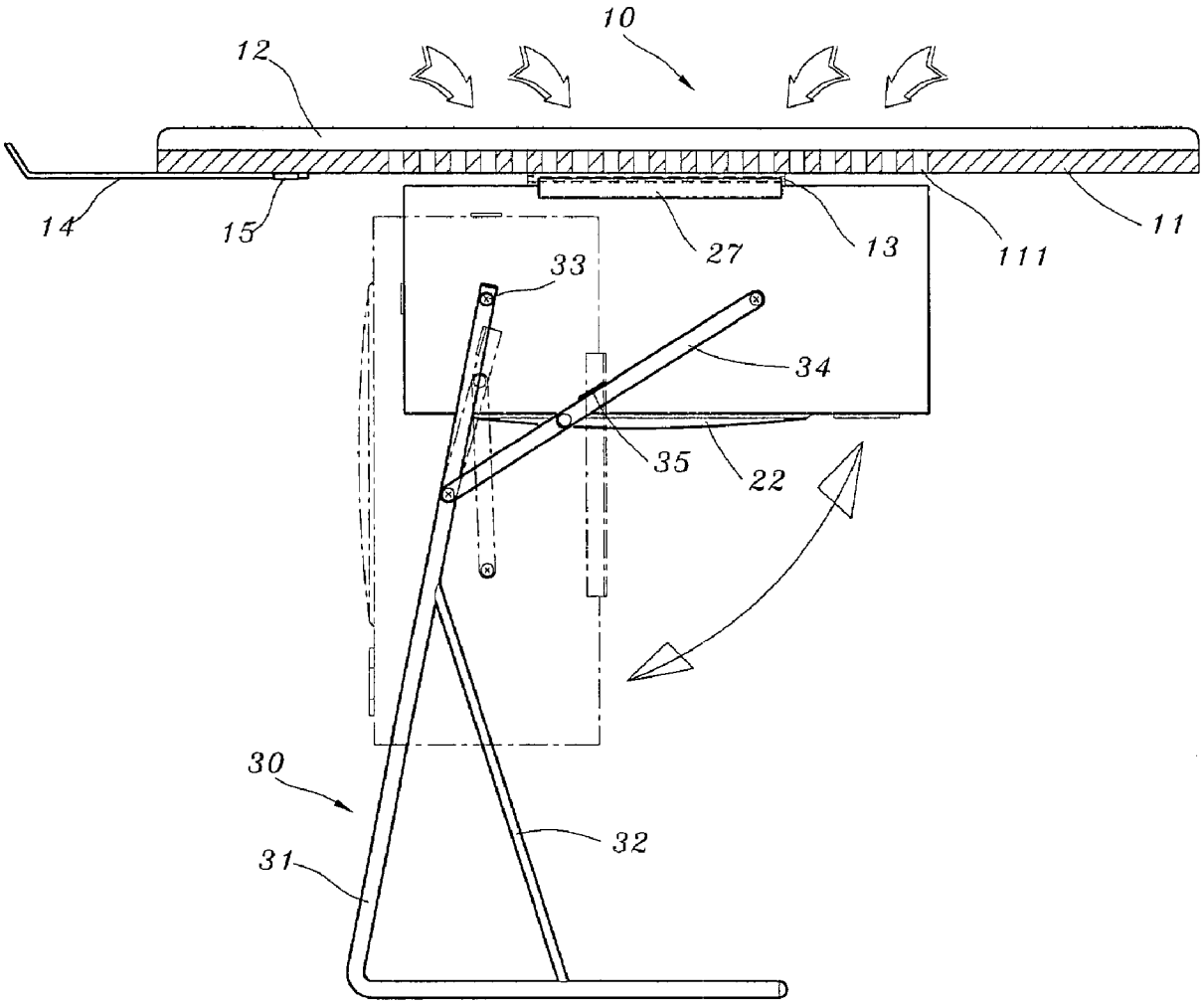
FIG. 5 shows an operational schematic side view according to the invention.

Referring to FIGS. 1~5, the invention of a modularized multifunctional ironing board with fan, consisting mainly of an ironing board (10), a fan box (20), and supporting all the above a rack assembly base (30).

A board proper (11) of the ironing board (10) has a plurality of ventilation holes (111). On top there is a cotton fabric layer (12). The fan box (20) is positioned in the middle of the board proper (11). On the edges of the bottom of the board proper (11), there are two conjoining slides (13) for assembling the board proper (11) with the fan box (20). There is an iron rack (14) being fixed in place by rack stabilizers (15) at the end of the board proper (11).

The fan box (20), after placing a fan (21) therein and covering the fan (21) with a fan mesh (22), has power sockets (23) to provide electricity for iron and other relevant appliances and a row of fan speed-direction switches (24) next to the power sockets (23). On the symmetric sides of the fan box (20), screw holes for fan box (25) and screw holes for extension rods (26) are formed. A protective mesh (28) covers the fan on the opposite side of the fan mesh (22).

The rack assembly base (30) is of a unibody construction forming supporting racks (31) in between which a supporting rod (32) is welded to the supporting racks (31) thereby resulting a stable assembly. The fan box (20) is positioned and fixed to the assembly by screw rod-screw sets (33) through the screw holes (25). Supporting the fan box (20) and making it rotatable by extension rods (34) with rod stoppers (35) is achieved by screw fastening on the other side through the screw holes for extension rods (26). Now the whole assembly is foldable and extendible to a level platform for ironing by the action of the board-fan conjoining slides (13) which is to be restrained with the other conjoining slides (27) by the rod stopper. Steam from an iron can be sucked out through the ventilation holes while the clothes being ironed are stationary by the suction power of the fan. The ironing board (10) can be slide out of the conjoining slides (13, 27) leaving a fan box-rack assembly base (20, 30) unit that can be transported by using the handle (29) on the fan box (20). The fan speed and direction can be adjusted by the switches (24).

The advantages of the aforesaid invention are as follows:

1. The modularized multifunctional ironing board with fan utilizes the suction power produced based on the principles of aerodynamics. Through the ventilation holes, the suction power stabilizes the clothing, limits the steam to a concentrated area.
2. The user doing the ironing can also enjoy the breeze produced by the fan.
3. The power sockets provide easy access to electricity for the iron and other appliances.
4. The invention can convert the whole assembly into a simple fan adjustable for speed and direction. The power outlet provides access for appliances, truly exhibiting practicality and multiplicity of function.

It is of course to be understood that the embodiment described herein is merely illustrative of the principles of the invention and that a wide variety of modifications thereto may be effected by persons skilled in the art without departing from the spirit and scope of the invention as set forth in the following claims.

The invention claimed is:

1. A modularized multifunctional ironing board with fan comprising:

an ironing board, a fan box, and a rack assembly base of which:

the ironing board, including a board having a plurality of ventilation holes, on top the board proper a cotton fabric layer is placed, with the fan box positioned in the middle of the board proper, the edges of the bottom of the board proper having two conjoining slides to assemble the fan boxes; an iron rack being fixed in place by rack stabilizers with a plurality of screws at the end of the board proper;

the fan box, after placing a fan and covering the fan with a fan mesh having power sockets to provide electricity for iron and other relevant appliances and a plurality of fan speed-direction switches next to the power sockets; forming on the symmetric sides of the fan box screw holes for fan box and screw holes for extension rods; placing a protective mesh to cover the fan on the opposite side of the fan mesh;

the rack assembly base being of a unibody construction forming supporting racks in between which a supporting rod is welded to the supporting racks thereby resulting a stable assembly, moreover, positioning and fixing the fan box to the assembly by screw rod-screw sets through the screw holes for supporting the fan box and making it rotatable by extension rods with rod stoppers achieved by screw fastening on the other side through the screw holes for extension rods rendering the whole assembly foldable and extendible to a level platform for ironing by the action of the board-fan conjoining slides; when in use, steam from an iron can be sucked out through the ventilation holes while the clothes being ironed are stationary by the suction power of the fan.

2. A modularized multifunctional ironing board with fan as recited in claim 1, wherein the ironing board can be slided out of the conjoining slides by the action of the rod stopper whereby leaving the fan box-rack base as an independent vertical unit and that being able to be transported by using the handle on the fan box, and the fan speed and direction can be adjusted by the switches.

* * * * *